United States Patent [19]

Maruo

[11] 4,122,426

[45] Oct. 24, 1978

[54] TIME-LAG FUSE

[75] Inventor: Masaya Maruo, Yokohama, Japan

[73] Assignee: San-O Industrial Corp., Tokyo, Japan

[21] Appl. No.: 762,183

[22] Filed: Jan. 24, 1977

[30] Foreign Application Priority Data

Feb. 3, 1976 [JP] Japan ..... 51-10034

[51] Int. Cl.[2] ..... H01H 85/04

[52] U.S. Cl. ..... 337/163; 337/297

[58] Field of Search ..... 337/163, 164, 165, 166, 337/297, 295

[56] References Cited

U.S. PATENT DOCUMENTS

| | | | |
|---|---|---|---|
| 3,267,738 | 8/1966 | Arikawa et al. | 337/164 |
| 3,845,439 | 10/1974 | Deelman | 337/295 |
| 3,858,142 | 12/1974 | Deelman et al. | 337/163 X |
| 3,869,689 | 3/1975 | Kasamatu | 337/164 |
| 4,057,774 | 11/1977 | Arikawa et al. | 337/164 |

FOREIGN PATENT DOCUMENTS

| | | | |
|---|---|---|---|
| 1,965,520 | 7/1970 | Fed. Rep. of Germany | 337/166 |

*Primary Examiner*—George Harris

[57] ABSTRACT

A time-lag fuse constructed so that a fuse element is wound on a core member made of a ceramic material having high thermal conductivity, for example, a material comprising high weight per cent aluminum oxide ($Al_2O_3$, 85 – 100 wt.%). The fuse has excellent time-lag characteristics imparted by the strong heat-absorbing action of said high weight per cent aluminum oxide.

3 Claims, 1 Drawing Figure

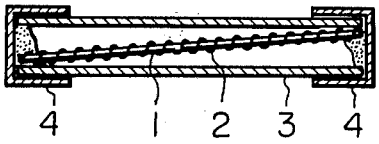
4
1
2
3
4

TIME-LAG FUSE

BACKGROUND OF THE INVENTION

This invention relates to a time-lag fuse in which a fuse element is wound on an elongated core member having high-thermal conductivity.

Time-lag fuses used in the past have some defects such that they are inferior in temperature characteristics to widely vary in time-lag characteristics. As an improvement developed and eliminate such defects, there are time-lag fuses in which a fuse element is spirally wound on an elongated core member made of a sintered ceramic material. This invention is an improvement made further on such time-lag fuse as a fuse for motor protection.

One object of this invention is to provide a time-lag fuse in which a fuse element is wound on an elongated core member having high thermal conductivity, said fuse protecting a motor without melting even when a large drive current generated at the initial stage of the current flow.

Another object of this invention is to provide a time-lag fuse having excellent time-lag characteristics in which the elongated core member is made of a material comprising high weight percent aluminum oxide.

SUMMARY OF THE INVENTION

The time-lag fuse of this invention is constructed in such a manner that a fuse element is wound on an elongated core member having high thermal conductivity (more than about 14 kcal/m.hr.° C). In this invention, the core member used for winding the fuse element therearound and in close contact therewith should have a strong heat-absorbing action for improving the time-lag characteristics. That is, a material to be used as the core member is selected from among those which have high thermal conductivity; therefore, when a large current generated at the start time of a motor flows, the high temperature generated from the fuse element is absorbed by the strong endothermic action of the core member in contact with the fuse element, so that it is possible to realize excellent time-lag characteristics on the order of several times the rated current capacity, whereby it becomes possible for the fuse to protect the motor without melting.

The relationship between the composition of aluminum oxide and the thermal conductivity thereof is shown in the following table.

| Material | Composition wt. % | Thermal Conductivity at 100° C, kcal/m.hr.° C | Water absorptivity % |
|---|---|---|---|
| Fused alumina | $Al_2O_3$ 100 | 26.0 | 0 |
| " | $Al_2O_3$ 99 | 18.0 | 0 |

-continued

| Material | Composition wt. % | Thermal Conductivity at 100° C, kcal/m.hr.° C | Water absorptivity % |
|---|---|---|---|
| Fused alumina | $Al_2O_3$ 96 | 18.0 | 0 |
| " | $Al_2O_3$ 85 | 14.4 | 0 |
| Pure alumina | $Al_2O_3$ 99 | 14.4 | 5 - 12 |

As shown in the table, a ceramic material made of high weight percent aluminum oxide is very superior in high thermal conductivity. Therefore, the object of this invention, that is, to improve the thermal conductivity, is achieved by using a ceramic material made of high (85 - 100) weight percent aluminum oxide as the core member.

BRIEF DESCRIPTION OF THE DRAWING

The drawing is a side sectional view of the time-lag fuse of this invention.

DESCRIPTION OF PREFERRED EMBODIMENT

Referring now to drawing, there is shown the construction of a time-lag fuse according to this invention in which a fuse element 2 is wound on an elongated core member 1 made of a ceramic material comprising high weight percent aluminum oxide, for example, 96% fused alumina, said core member being disposed in an insulated tubular member 3 diagonally and in intimate contact with sealing means 4 at both ends.

When a large current generated at the initial stage of motor driving flows to the fuse element, the core member 1 having high thermal conductivity absorbs the heat from the fuse member, so that it is possible, without the fuse melting, to drive the motor; the fuse is strikingly superior in time-lag characteristics.

In one tests, the time-lag fuse of this invention having a rated current capacity of 4.3 amperes remained unchanged even when a current of 16 amperes was applied for 3 seconds, and, also, did not melt even when a current of 22 amperes was applied for 1.5 seconds.

Thus, the time-lag fuse of this invention has really excellent time-lag characteristics imparted by the strong heat-absorbing action due to high thermal conductivity of the ceramic material consisting of high weight percent alumina.

What is claimed is:

1. A time-lag fuse comprising an insulated tubular member having two ends, sealing means at both said ends, an elongated core member disposed in said tubular member in contact with said sealing means, and a fuse element wound on said core member and fixed at both ends thereof, said core member being a ceramic material consisting of from about 85 to about 100 weight percent aluminum oxide.

2. A time-lag fuse as in claim 1, wherein said core member has a thermal conductivity of more than about 14 kcal/m.hr.° C.

3. A time-lag fuse as in claim 1, wherein said ceramic material consists essentially of aluminum oxide.

* * * * *